United States Patent [19]

Gewartowski

[11] 4,082,654

[45] * Apr. 4, 1978

[54] FRACTIONATION TO REMOVE A HIGH-BOILING MATERIAL AND A DISSOLVED SUBSTANCE

[75] Inventor: Steve A. Gewartowski, Mount Prospect, Ill.

[73] Assignee: UOP Inc., Des Plaines, Ill.

[ * ] Notice: The portion of the term of this patent subsequent to Feb. 15, 1994, has been disclaimed.

[21] Appl. No.: 737,127

[22] Filed: Oct. 29, 1976

Related U.S. Application Data

[63] Continuation-in-part of Ser. No. 583,740, Jun. 4, 1975, Pat. No. 4,008,150.

[51] Int. Cl.[2] ..... B01D 3/06; C01G 7/00

[52] U.S. Cl. ..... 208/352; 208/354

[58] Field of Search ..... 208/352, 354, 361, 351, 208/350

[56] References Cited

U.S. PATENT DOCUMENTS

| | | | |
|---|---|---|---|
| 2,368,497 | 1/1945 | Shipley et al. | 208/361 |
| 3,444,052 | 5/1969 | Bracken et al. | 208/352 |
| 4,008,150 | 2/1977 | Gewartowski | 208/352 |

*Primary Examiner*—Herbert Levine

*Attorney, Agent, or Firm*—James R. Hoatson, Jr.; John F. Spears, Jr.; William H. Page, II

[57] ABSTRACT

An improved method of simultaneously removing high-boiling materials and a volatile dissolved substance, such as carbon dioxide or hydrogen sulfide, from a hydrocarbon stream as is performed in feed preparation columns. About 25 to 75 percent of the feed stream is vaporized in a flash zone, and the vapor stream from the flash zone is combined with the overhead vapor stream of a fractionation column. The liquid remaining after the flash operation is passed into a lower intermediate point of the fractionation column. The high-boiling materials are removed at the bottom of the column, and the product stream is removed from the fractionation column at a higher intermediate point.

6 Claims, 1 Drawing Figure

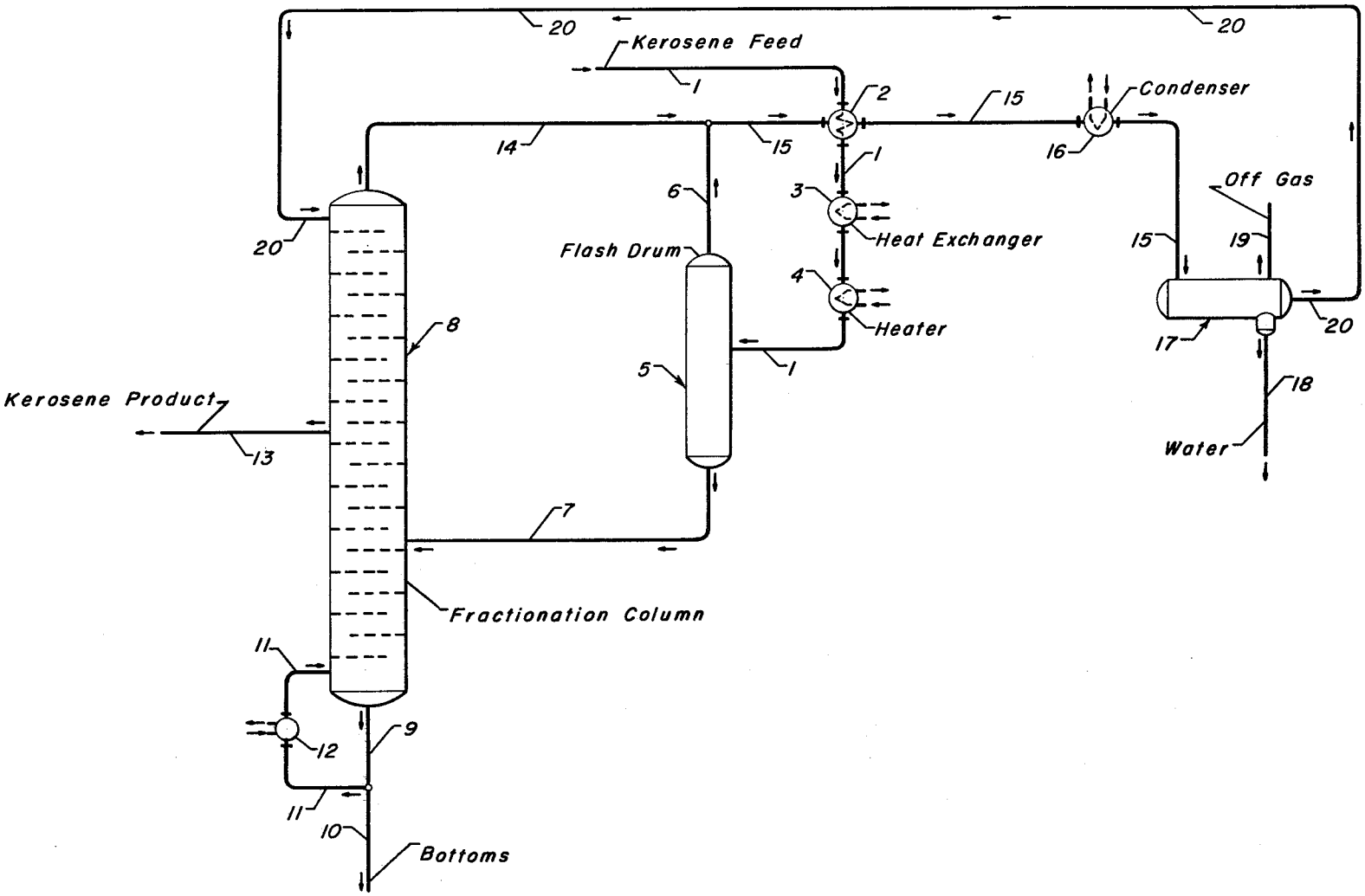
Kerosene Feed
Condenser
Off Gas
Water
Heat Exchanger
Heater
Flash Drum
Fractionation Column
Bottoms
Kerosene Product

FRACTIONATION TO REMOVE A HIGH-BOILING MATERIAL AND A DISSOLVED SUBSTANCE

CROSS-REFERENCE TO RELATED APPLICATION

This is a Continuation-In-Part of my prior copending application Ser. No. 583,740 which was filed on June 4, 1975 now U.S. Pat. No. 4,008,150.

FIELD OF THE INVENTION

The invention relates to a process for separatory distillation. The invention more specifically relates to a process in which a hydrocarbonaceous feed stream is treated for the removal of both a high-boiling material and a dissolved volatile substance through the sequence comprising a flashing operation and a fractional distillation.

PRIOR ART

The art of distillation has reached a high level of sophistication, and references do show both of the operations of flash distillation and fractional distillation. However, they are not operated and combined as in the present invention. An example is presented by U.S. Pat. No. 3,798,153 (Cl. 208-48AA). This reference illustrates a method used in the fractionation of crude oil, wherein the charge stream to the crude oil column is first passed into a flash drum and the liquid from the flash drum is then passed into an intermediate point of the crude oil column. Compared to the invention, the vapors removed from the flash drum are passed into the crude oil column at substantially the same point at which the liquid material is passed into the column. Furthermore, the reference describes this method of operation as being utilized only in order to reduce the flow rate in the furnace through which the liquid material is passed.

U.S. Pat. No. 3,444,052 (Cl. 203-1) describes a method to control the flow of flash drum liquid and vapor streams. In this reference a stream of rich oil from an absorber is flashed, and the resultant vapor and liquid streams are divided into two or more smaller streams for passage into two or more separate demethanizers. The smaller vapor streams are then fed to the top of each column, and the separate liquid streams are fed to an intermediate point in each column. Light gases stripped from the rich oil are vented from a single overhead receiver. The only liquid product stream removed from these columns is a lean oil bottoms stream.

Other uses of an independent flashing operation in conjunction with a fractionation operation are disclosed in U.S. Pat. Nos. 2,368,497; 2,426,110; 3,079,330 and 2,008,578.

BRIEF SUMMARY OF THE INVENTION

The invention provides an improved method for the fractionation of hydrocarbon feed streams, such as a naphtha or kerosene, whereby it is possible to remove both volatile dissolved substances and high-boiling materials in one fractionation column. The invention comprises the steps of passing the feed stream into a flash zone and effecting the vaporization of a substantial portion of the feed stream to form a flash vapor stream comprising the dissolved substance and a flash liquid stream comprising the high-boiling material, passing the flash liquid stream into a distillation column at a lower intermediate point, combining the flash vapor stream with an overhead vapor stream which is removed from the distillation column and partially condensing the resultant composite vapor stream to form reflux, removing a vapor stream comprising the dissolved substance from an overhead receiver, removing a bottoms stream comprising the high-boiling materials from the distillation column, and removing the now treated product stream from an upper intermediate point in the distillation column.

By the method of the invention, substantially all of the volatile substance dissolved in the feed stream is combined with the overhead vapor stream of the fractionation column and is eventually vented off of the overhead receiving vessel as a vapor or liquid. Any of this substance entering the reflux liquid is returned to the receiver in the overhead vapors. At the same time, substantially all the high-boiling material is caused to enter the fractionation column at a lower intermediate point with the flash zone liquid stream, which is then subjected to fractional distillation for the concentration of this material and its removal as a bottoms liquid stream. The net effect is that the volatile dissolved substance is caused to enter the top of the fractionation column and the high-boiling material is caused to enter near the bottom of the fractionation column. Both contaminants may then be separated from the material forming the net product stream of the column withdrawn at an intermediate point by the ordinary process of fractionation. It is therefore not necessary to utilize two fractionation columns in order to remove different materials having boiling points that bracket the material being treated or desired as the product.

DESCRIPTION OF THE DRAWING

The drawing illustrates the preferred embodiment of the invention as used to remove dissolved oxygen, water and a bottoms fraction from a kerosene. This kerosene contains a large number of different hydrocarbons having boiling points in the range of about 200° C. to about 344° C. For simplicity and clarity of description, obviously needed equipment such as pumps and control systems have not been included. The kerosene feed stream enters the process through line 1 and is heat-exchanged with a hereinafter described composite vapor stream passing through line 15 in a heat-exchange means 2. The kerosene feed stream continues through line 1 and is further heat-exchanged in a heat-exchange means 3 and then passed through a heater 4. The kerosene feed stream passes into a flash drum 5 wherein there is effected the separation of the feed stream into a flash drum vapor stream containing substantially all of the oxygen and water which was originally dissolved in the feed stream and which is removed through line 6. There is also effected the formation of a flash drum liquid stream removed through line 7 and which contains substantially all of the high-boiling materials originally found in the kerosene feed stream. The flash drum liquid stream is passed into a lower intermediate point of the fractionation column 8. The normal fractional distillation operation results in the concentration of these higher boiling materials in a bottoms stream which is removed from the fractionator through line 9. A first portion of the bottoms stream is removed through line 10 as the net bottoms product, and a second portion is passed through line 11 and vaporized in a reboiler means 12 to supply the heat necessary for the fractionation operation. The net bottoms stream comprises a high-boiling portion of the kerosene feed stream containing various hydrocarbons having boiling points above about 300° C.

An overhead vapor stream is removed from the top of the fractionator 8 through line 14 and admixed with the flash drum vapor stream passing through line 6. This effects the formation of the composite vapor stream passing through line 15. This vapor stream is first heat-exchanged with the feed stream in the heat-exchange means 2 and then passed through a condenser 16 to effect the condensation of substantially all of the kerosene boiling range hydrocarbons contained within the composite vapor stream. The material in line 15 is then passed into the overhead receiver 17 wherein the aqueous and hydrocarbon phases of the condensate are separated. Uncondensed materials, including dissolved oxygen and water vapor removed from the feed stream are vented from the overhead receiver through line 19, and liquid water is decanted from the overhead receiver through line 18. A reflux stream is removed from the overhead receiver and transported through line 20 to the top of the fractionation column. This results in the return of the kerosene vaporized in the flash drum to the fractionation column. Any oxygen or water which remains dissolved in the kerosene forming the reflux stream is subsequently stripped from this material in the upper section of the column. A kerosene product stream is removed through line 13 as a side-cut taken at an upper intermediate point and is substantially free of both the formerly dissolved oxygen and the high-boiling materials.

DETAILED DESCRIPTION

It is often required to process hydrocarbon streams which have been stored for a substantial amount of time or which have been transported to the processing unit from a different location. In either of these situations the hydrocarbon stream is likely to pick up a mixture of contaminants. For instance, a detrimental amount of oxygen becomes dissolved in hydrocarbon streams which have been stored for any length of time without being blanketed by inert gases or hydrocarbon vapors. Also, because of these periods of storage or as the result of prior processing, the hydrocarbon streams may contain undesirable high-boiling contaminants. One example of these contaminants is the mixture of polymeric substances commonly referred to as "gum" which tends to form in certain hydrocarbon products. These gums result from the combination of olefins or diolefins such as are formed when a naphtha is produced in a fluid catalytic cracking operation. The hydrocarbon feed stream can also pick up other contaminants such as residual amounts of whatever substance was previously stored or transported through the same system which is delivering the feed stream. These contaminants therefore originate in the storage tank, pipeline, barge or other vessel in which the feed stream was previously contained. Another contaminant which tends to find its way into feed streams is water, which may result from either dissolution or condensation. It is normally desirable or necessary to remove these and other contaminants from the feed stream before it is charged to many different types of processing operations. For instance, these substances may tend to deactivate the catalyst or to speed the rate at which the catalyst bed becomes plugged. Either situation is detrimental to the optimum performance of the process. Hydrocarbon streams are also treated to bring them into conformity with quality specifications or to recover certain materials.

It is a common practice in the petroleum and petrochemical industries to subject the feed stream to some sort of feed preparation or product purification procedure which will remove the undesired materials. This procedure is most commonly a fractional distillation operation. At the same time that the feed stream is being processed for the removal of volatile substances, some of the higher boiling or lower boiling material in the feed stream itself may be cut from it in order to adjust the boiling point range of the feed stream. The subject process may therefore include the removal of up to about 20% of the highest boiling materials comprising the feed stream.

By the method of the prior art it is necessary to subject the feed stream to two sequential fractionation operations when a feed stream is processed for the removal of components having boiling points both above and below the median of the feed stream. The fractionation of a hydrocarbon stream requires the expenditure of a sizable amount of energy to perform the necessary vaporization. When two fractionation columns are used in sequence, it is normally necessary to vaporize a very large portion of the material which enters each column, and the energy required to operate the two columns is normally greater than that required for one. It is the objective of this invention to reduce the amount of energy which is required for the removal of both high-boiling and low-boiling materials from a particular feed stream by the provision of a process which allows this operation to be conducted within only one fractionation column.

This objective is obtained by first subjecting the feed stream to a flashing operation to effect the formation of a single flash vapor stream and a single flash liquid stream, each of which comprises a sizable percentage of the feed stream. By careful adjustment of the flashing operation it is possible to concentrate substantially all of the more volatile materials which are to be removed in the flash vapor stream and to simultaneously concentrate substantially all of the less volatile materials which are to be removed in the flash liquid stream. These two streams are then passed into the fractionation column near the extremities of the column. In this manner, the two contaminants are forced to enter the column at these extremities. Specifically, by condensing the flash vapor stream and using this material as a portion of the reflux to the distillation column, the more volatile material is concentrated in the top of the fractionation column and will be prevented from migrating downward by the natural fractionation process. Likewise, the less volatile materials will enter a lower portion of the fractionation column and will be prevented from rising by the same fractionation process. By then removing the net product stream from an intermediate point in the fractionation column, it is possible to remove both of these contaminants in only one fractionation column. Furthermore, the amount of vaporization required in the flash zone will normally be less than that required in the fractionation column, and the total utilities consumption is thereby reduced. The cost of construction may also be reduced.

The process of the invention may be applied to any type of material which may be successfully submitted to a flashing operation which will concentrate substantially all of the two substances to be removed in the proper stream produced by the flashing operation. The invention may therefore be applied to a wide variety of petroleum or petrochemical feedstocks including naphtha and kerosene. As used herein, the term "feed stream" is intended to designate the stream which will be charged into the flash zone of the subject method. It is not intended to restrict the invention to practice with streams which will be subsequently charged into other processing units, although this will undoubtedly be one of the main applications of the method. That is to say, the invention may also be applied to the effluent streams of particular process units whenever the separation which may be performed by the method of the invention is desirable. It is therefore foreseen that the feed stream may comprise an effluent of a reforming process, a cracking process, an isomerization process, a hydrocracking or hydrotreating process, an alkylation process, a dehydrogenation process, etc. In these instances, the invention may be applied for the removal of such diverse volatile substances as hydrogen, inorganic catalyst promoters such as boron halides, and light hydrocarbon gases, with the simultaneous removal of heavier compounds such as polymers, alkylation products, gums or tar. Other volatile substances which may be removed from the feed stream include but are not limited to hydrogen sulfide, nitrogen, helium, carbon monoxide, carbon dioxide, ammonia, acetylene, ethylene, propylene, hydrogen fluoride, carbon tetrachloride and sulfur dioxide.

The invention is especially suited for the removal of a drag stream of high-boiling reaction by-products as is often necessary. In the preferred embodiment of the invention, a kerosene stream is acted upon to remove dissolved oxygen, water and high-boiling materials as a feed preparation step. This is often performed prior to hydrotreating a pyrolysis liquid which has been stored, as during periods when the hydrotreating operation is not operating. The invention may also be used to remove other dissolved volatile substances, such as water, in order to dry the feed stream and to remove light hydrocarbons, such as methane, ethane and butane. This latter operation is performed to improve the flash point of a kerosene or to lower the volatility of a gasoline. The invention can also be utilized when the feed stream is being split, as into light and heavy naphtha or kerosene fractions.

As used herein, the term "flash zone" is intended to refer to any vessel or apparatus wherein the previously heated feed stream is separated into a vapor phase stream and a liquid stream at a total pressure less than that at which it was heated. The feed stream and the flash zone are maintained at an elevated temperature to enhance the vaporization of the more volatile compounds, and the pressure reduction is performed to increase the amount of the feed stream which is vaporized. The construction of the flash zone, commonly referred to as a flash drum, is not controlling on the performance of the invention as long as it provides suitable operation. The flash zone may contain various baffles or other means to physically aid the separation of vapor from the liquid. The temperature and pressure utilized in the flashing operation are of course interdependent and will be set by the composition of the feed stream and the volatility and concentration of those materials which are to be removed. These conditions may be chosen by those skilled in the art to provide the necessary vaporization of a portion of the feed stream containing 25–75 vol.% of the feed stream. Preferably, about 40–60 vol.% of the feed stream is vaporized and becomes the flash vapor stream.

The flash liquid stream is fed into the distillation column at an intermediate point. As used herein, the term "intermediate point" is intended to refer to a point in a distillation column which is separated from the extremities of the distillation column by one or more fractionation trays. That is to say, an intermediate point is below the top tray of the fractionation column and above the bottom tray of the fractionation column. The major product stream removed from the fractionation column is withdrawn at a second or upper intermediate point which is located above the location at which the flash liquid stream enters the fractionation column. These two intermediate points are separated by one or more fractionation trays or their equivalent. If the fractionation column does not contain trays, that is if it is a packed column, then an intermediate point is removed from the extremities of the column by at least that amount of packing necessary to perform a separation equal to one-half that provided by a theoretical fractionation tray. Likewise, the upper and lower intermediate points are also separated by at least the amount of packing necessary to perform a degree of separation equal to one-half of a theoretical tray.

The flash vapor stream is preferably combined with the overhead vapor removed from the fractionation column to effect the formation of a composite vapor stream. This vapor stream is preferably heat-exchanged to recover heat and then passes through a condensation zone. However, the overhead vapor stream and the flash vapor stream may be passed through individual lines leading through different heat-exchange and condensation means. In either case, the total of the material which comprises these two streams is directed into the overhead receiver of the fractionation column and eventually commingled. Water or other materials which form a separate liquid phase are then removed by decantation. The uncondensible vapors are normally vented off. These vapors often contain substantially all of the more volatile substance which is to be removed. The vapor stream removed from the overhead receiver can be subjected to further cooling or refrigeration to recover or remove valuable lighter hydrocarbons, and the temperature of the overhead receiver may be varied to change the composition and amount of these subsequently condensed materials.

All of the condensed hydrocarbons may be transferred to the column as a reflux stream, or a portion of this stream may be diverted. As used herein, the terms "reflux" or "reflux liquid" refer to a hydrocarbon material which is formed in part by the condensation of the overhead vapor stream removed from the fractionation column. It differs from what is usually thought of as reflux in that it contains heavy material ordinarily not present in the overhead vapor stream and in that it may contain more material than the overhead vapor stream. It is therefore similar to the reflux stream fed to a benzene drying column when the feed stream is charged into the overhead receiver.

As used herein, the term "substantially all" is intended to indicate the transfer or removal of at least 95 vol.% of the subject material. For instance, when it is stated that the flash vapor stream contains substantially all of the volatile dissolved substance, then the flash vapor stream will contain at least 95 vol.% of this dissolved substance which is contained in the feed stream prior to its entrance into the flash zone.

As used herein, the term "high-boiling material" is used to indicate the portion of the feed stream removed as the bottoms stream and has a meaning which is relative to the composition of the feed stream. This is because of the great variation which is possible in the composition of the feed stream. If a mixture of a wide number of different compounds having a relatively smooth boiling point curve, as typified by petroleum fractions such as naphthas and fuel oils, constitutes the material forming the feed stream then the high-boiling material consists of those compounds which have a boiling point which is higher than the temperature corresponding to what is commonly referred to as the 90% point of the feed stream. At the other extreme, if the feed stream is comprised of more than 25% of one particular chemical species, then the term "high-boiling material" includes anything having a boiling point 10° C. higher than this predominant species.

The high-boiling materials themselves may be polyalkylated materials formed in a reaction zone, polymers formed as reaction by-products, tars, gum and other impurities, small amounts of residual oils which have contaminated the feed stream or materials substantially similar to that comprising the great bulk of the feed stream but remaining in the feed stream due to a prior poor fractionation or intentional fractionation to produce a different boiling point range. When the subject process is being used on a naphtha feed stream, that is one comprising a mixture of hydrocarbons having boiling points in the range of about 40° C. to about 260° C., the high-boiling material may be one or more hydrocarbons having a boiling point of from about 204° C. to about 260° C. When a kerosene feed stream, this one containing a mixture of hydrocarbons having boiling points within the range of about 200° C. to about 344° C., the high-boiling material can be a hydrocarbon having a boiling point of from about 300° C. to 344° C.

In accordance with the prior description, a broad embodiment of my invention may be characterized as a method for removing a high-boiling material and a volatile dissolved substance chosen from the group consisting of hydrogen, oxygen, methane, ethane, propane, butane and water from a hydrocarbonaceous feed stream comprising hydrocarbons having boiling points in the range of about 40° C. to about 344° C. which comprises the steps of passing the feed stream into a flash zone and effecting the vaporization of about 25 to 75 vol.% of the feed stream and the formation of a single flash vapor stream comprising substantially all of the volatile dissolved substance and a single flash liquid stream comprising substantially all of the high-boiling material, passing the flash liquid stream into a fractionation column at a first intermediate point and effecting the fractional distillation of the flash liquid stream, removing an overhead vapor stream from the fractionation column, and passing the overhead vapor stream through a condensation zone and into an overhead receiver, passing the flash vapor stream through a condensation zone and into the overhead receiver, removing a reflux stream from the overhead receiver and passing the reflux stream into the fractionation column, removing a vapor stream comprising the dissolved substance from the overhead receiver, removing a product stream from the fractionation column at a second intermediate point located above the first intermediate point and, removing a bottoms liquid stream comprising the high-boiling material from the fractionation column.

Those skilled in the art will appreciate the fact that the invention may be adapted to specific feed stocks through minor variations and additions to this broad embodiment or the illustrated preferred embodiment. For instance, it may be desirable to separate a light normally liquid portion of the feed stream from the material forming the product stream. One example of this would be the removal of pentanes and hexanes from a gasoline stream. This could be performed by either removing a liquid stream from the overhead receiver or by removing a second sidecut from the column at an intermediate point above where the main product stream is removed. The material removed by these methods will also contain some of the heavier material since it is found in the flash vapor stream. For this reason, it may be necessary to perform a further purification of the resultant stream of light liquid. This can be accomplished by a side-cut stripping operation similar to those used on crude oil distillation columns.

To insure a complete understanding of the invention an example will be given of its use in the preparation of the naphtha feed stream for a synthetic natural gas plant. The example is based on a design for summer operating conditions and a feed stream of 1,160,000 lbs/hr. (112,818 barrels per stream day) of a 69.3 °API naphtha. The feed stream enters at a temperature of 100° F. and a pressure of 72 psig. and is then heat-exchanged with the overhead vapor stream of the prefractionator. After this heat-exchange, the feed stream has a temperature of 272° F. and is heat-exchanged with the effluent stream of a hydrotreating reaction zone, which results in the temperature being raised to 323° F. At this point, the feed stream has a pressure of about 60 psig. The feed stream is then passed through a preheater and into the flash drum at a temperature of 335° F. and a pressure of 52 psig. The flashing operation effects the formation of a flash liquid stream comprising 589,930 lbs/hr. and a flash vapor stream of 570,070 lbs/hr.

The flash liquid stream is fed onto the twenty-first tray from the top of the prefractionator at a temperature of 335° F. A 150,533 lbs/hr. overhead vapor stream is removed from the prefractionator at a temperature of 290° F. and admixed with the flash vapor stream to form the composite vapor stream. This vapor stream is heat-exchanged with the feed stream and fed into an overhead condenser at a temperature of 272° F. The effluent of the overhead condenser is then passed into an overhead receiver at a temperature of about 150° F., and the different phases are allowed to separate. A reflux stream of 720,603 lbs/hr. is removed from the overhead receiver and passed into the top of the prefractionator. The reflux stream contains essentially all of the hydrocarbons in the composite vapor stream formed by the overhead vapor and flash vapor. A liquid stream of 1,317,193 lbs/hr. is removed from the bottom of the prefractionator as the total column bottoms. Of this amount, 1,203,193 lbs/hr. is passed into a reboiler at a temperature of 385° F. Approximately one-half of this material is vaporized, and a mixed phase stream is then passed into the prefractionator of 402° F. The net bottoms stream removed from the prefractionator consists of 114,000 lbs/hr. of a 61.4 °API naphtha. The net sidecut product stream consists of 1,046,000 lbs/hr. of a 70.2 °API naphtha which is removed between the twelfth and thirteenth tray of the column at a temperature of 293° F. and a pressure of 54 psig.

I claim as my invention:

1. A method for removing a high-boiling material and a volatile dissolved substance chosen from the group consisting of hydrogen sulfide, nitrogen, sulfur dioxide, helium, carbon monoxide, carbon dioxide, ammonia, acetylene, ethylene, propylene, boron trifluoride, hydrogen fluoride and carbon tetrachloride from a naphtha feed stream comprising hydrocarbons having boiling points in the range of about 40° C. to about 260° C. which comprises the steps of:

(a) passing said feed stream into a flash zone and effecting the vaporization of about 25 to 75 vol.% of said feed stream and the formation of a single flash vapor stream comprising substantially all of the volatile dissolved substances and a single flash liquid stream comprising substantially all of the high-boiling material;

(b) passing said single flash liquid stream into a fractionation column at a first intermediate point and effecting the fractional distillation of said single flash liquid stream;

(c) removing an overhead vapor stream from said fractionation column, and passing said overhead vapor stream through a condensation zone and into an overhead receiver to remove at least a portion of the volatile dissolved substances therein and to condense said overhead vapor stream;

(d) passing said single flash vapor stream through a condensation zone and into said overhead receiver to remove at least a portion of said volatile dissolved substances before charge to said fractionation column and to condense said single flash vapor stream to a liquefied flash stream;

(e) removing a reflux stream comprising an admixture of said condensed overhead stream and said liquefied flash stream from said overhead receiver and passing said reflux stream into an upper portion of said fractionation column;

(f) removing a vapor stream comprising said dissolved substances from said overhead receiver;

(g) removing a substantially dissolved volatile and high-boiling material free product stream from the fractionation column at a second intermediate point located above the first intermediate point; and, (h) removing a bottoms liquid stream comprising the high-boiling material from the fractionation column.

2. The method of claim 1 wherein the high-boiling material is a hydrocarbon having a boiling point in the range of about 204° C. to about 260° C.

3. The method of claim 1 wherein said single flash vapor stream and said overhead vapor stream are combined and then passed through the same condensation zone.

4. A method of removing a high-boiling material and a volatile dissolved substance chosen from the group consisting of hydrogen, oxygen, nitrogen, helium, hydrogen sulfide, sulfur dioxide, ammonia, methane, acetylene, ethane, ethylene, propane, propylene, butane, boron trifluoride, hydrogen fluoride, carbon tetrachloride and water from a kerosene feed stream comprising hydrocarbons having boiling points in the range of about 200° C. to about 344° C. which comprises the steps of:

(a) passing said feed stream into a flash zone and effecting the vaporization of about 25 to 75 vol.% of said feed stream and the formation of a single flash vapor stream comprising substantially all of the volatile dissolved substances and a single flash liquid stream comprising substantially all of the high-boiling material;

(b) passing said single flash liquid stream into a fractionation column at a first intermediate point and effecting the fractional distillation of said single flash liquid stream;

(c) removing an overhead vapor stream from said fractionation column, and passing said overhead vapor stream through a condensation zone and into an overhead receiver to remove at least a portion of the volatile dissolved substances therein and to condense said overhead vapor stream;

(d) passing said single flash vapor stream through a condensation zone and into said overhead receiver to remove at least a portion of said volatile dissolved substances before charge to said fractionation column and to condense said single flash vapor stream to a liquefied flash stream;

(e) removing a reflux stream comprising an admixture of said condensed overhead stream and said liquefied flash stream from said overhead receiver and passing said reflux stream into an upper portion of said fractionation column;

(f) removing a vapor stream comprising said dissolved substances from said overhead receiver;

(g) removing a substantially dissolved volatile and high-boiling material free product stream from the fractionation column at a second intermediate point located above the first intermediate point; and, (h) removing a bottoms liquid stream comprising the high-boiling material from the fractionation column.

5. The method of claim 4 wherein the high-boiling material is a hydrocarbon having a boiling point in the range of about 300° C. to about 344° C.

6. The method of claim 4 wherein said single flash vapor stream and said overhead vapor stream are combined and then passed through the same condensation zone.

* * * * *